US012672717B2

(12) United States Patent
Neuhaus et al.

(10) Patent No.: US 12,672,717 B2
(45) Date of Patent: Jul. 7, 2026

(54) CARRIAGE FOR A LINEAR GUIDE SYSTEM

(71) Applicant: Accuride International GmbH, Diez (DE)

(72) Inventors: Christoph Neuhaus, Niederelbert (DE); Patrick Neidhöfer, Seelbach (DE); Jürgen Heinz, Berod (DE)

(73) Assignee: Accuride International GmbH, Diez (DE)

( * ) Notice: Subject to any disclaimer, the term of this patent is extended or adjusted under 35 U.S.C. 154(b) by 127 days.

(21) Appl. No.: 18/646,953

(22) Filed: Apr. 26, 2024

(65) Prior Publication Data

US 2024/0358152 A1 Oct. 31, 2024

(30) Foreign Application Priority Data

Apr. 28, 2023 (DE) ..... 10 2023 111 118 .3

(51) Int. Cl.
*A47B 88/483* (2017.01)
*A47B 88/473* (2017.01)

(52) U.S. Cl.
CPC ..... *A47B 88/483* (2017.01); *A47B 88/473* (2017.01)

(58) Field of Classification Search
None
See application file for complete search history.

(56) References Cited

U.S. PATENT DOCUMENTS 2,250,895 A * 7/1941 Premo ..... A47B 88/57 312/334.11
2,267,043 A * 12/1941 Premo ..... A47B 88/447 312/331
6,113,204 A * 9/2000 Jahrling ..... A47B 88/40 312/334.44
6,478,466 B1 * 11/2002 Chang ..... F16C 29/04 312/334.17

(Continued)

FOREIGN PATENT DOCUMENTS

DE 202015105035 U1 10/2015
DE 102020110563 A1 10/2021

(Continued)

OTHER PUBLICATIONS

Search Report received for DE Application No. 102023111118.3, mailed on Apr. 28, 2024, 7 pages (Original Document Only).

*Primary Examiner* — Hanh V Tran
(74) *Attorney, Agent, or Firm* — MEDLER FERRO WOODHOUSE & MILLS PLLC

(57) ABSTRACT

A carriage for a linear guide system including a rail element having two running surfaces facing towards each other and the carriage movable relative to the rail element in and against a pull-out direction is provided. The carriage includes a base body, a first pair of a first slider and a second slider with sliding surfaces facing away from each other. The sliding surfaces of the first slider, which is moveable relative to the base body in a direction perpendicular to the pull-out direction, and the second slider can each be brought into frictional engagement with one of the running surfaces and (Continued)

a spring element. The spring element is mounted on the base body in such a way that the spring element biases the first slider away from the second slider in the upward direction, and the second slider is fixed to the base body in the upward direction.

15 Claims, 3 Drawing Sheets

(56) References Cited

U.S. PATENT DOCUMENTS

| | | | | |
|---|---|---|---|---|
| 8,534,733 | B2 * | 9/2013 | Schreurs | B60N 2/02 296/1.09 |
| 8,876,230 | B2 * | 11/2014 | Lowe | A47B 88/49 312/319.1 |
| 10,124,706 | B2 * | 11/2018 | Zimmermann | A47B 88/487 |
| 10,584,746 | B2 * | 3/2020 | Moshammer | F16C 29/126 |
| 2015/0202763 | A1 | 7/2015 | Robson | |
| 2023/0160424 | A1 | 5/2023 | Neidhfer et al. | |
| 2024/0052884 | A1 * | 2/2024 | Neuhaus | A47B 88/487 |
| 2024/0052885 | A1 * | 2/2024 | Neidhöfer | F16C 29/001 |

FOREIGN PATENT DOCUMENTS

| | | | | |
|---|---|---|---|---|
| JP | 6392176 | B2 * | 9/2018 | |
| WO | WO-2007136442 | A2 * | 11/2007 | F16C 29/126 |
| WO | WO-2021209301 | A1 * | 10/2021 | F16C 29/007 |

* cited by examiner

CARRIAGE FOR A LINEAR GUIDE SYSTEM

The application claims priority of German patent application no. 10 2023 111 118.3, filed on Apr. 28, 2023, which is incorporated by reference herein in its entirety.

The present invention relates to a carriage for a linear guide system, wherein the linear guide system comprises a rail element having two running surfaces facing towards each other and the carriage movable relative to the rail element in and against a pull-out direction, wherein the carriage comprises a base body, a first pair of a first slider and a second slider having sliding surfaces facing away from each other, wherein the sliding surfaces of the first slider and the second slider can each be brought into frictional engagement with one of the running surfaces and wherein the first slider is mounted on the base body movably relative to the base body in an upward direction perpendicular to the pull-out direction, and a spring element, wherein the spring element is mounted on the base body in such a way that the spring element biases the first slider away from the second slider in the upward direction.

The present invention also relates to a linear guide system comprising such a carriage and a rail element, wherein the rail element comprises two running surfaces facing towards each other, wherein the carriage and the rail element are linearly displaceable relative to each other in and against the pull-out direction and wherein the first and the second slider are each in frictional engagement with one of the running surfaces of the rail element.

Linear guide systems comprising a carriage and a rail element are known from the prior art in a variety of embodiments. They are used in various household appliances, but also in automotive engineering and many other areas of application. In order to enable the carriage to move with as little friction as possible in relation to the rail element, rolling elements are typically located between the rail element and the carriage, wherein the rolling elements roll on a running surface of the rail element during a relative movement of the carriage and the rail element or perform a sliding movement in relation to the running surface. The resulting rolling and/or sliding friction is less than a direct sliding friction between the carriage and the sliding element. However, in such a linear guide system design, it is difficult to precisely adjust the force required to move the carriage relative to the rail element. In addition, the position of the carriage relative to the rail element cannot be precisely defined by the rolling elements in all operating situations.

Therefore, a carriage of the type mentioned at the beginning for a linear guide system and a linear guide system in which the carriage is primarily guided by sliding surfaces pointing away from each other are known from the prior art. Such sliding surfaces cannot perform any rolling movements relative to the running surfaces of the rail element due to their geometry or design. It is known to provide the sliding surfaces on sliders which are mounted on the base body so as to be movable in the upward direction perpendicular to the pull-out direction relative to the base body. In the prior art, two sliders are always pretensioned away from each other in the upward direction by at least one spring element and thus towards the running surfaces of the rail element. However, it has been shown that with such an arrangement of both a first and a second slider that are movable relative to the base body, clearance between the base body of the carriage and the rail element cannot be sufficiently reduced in all operating situations. This can lead to unfavourable acoustics and/or hap-tics for the user.

Therefore, the object of the present invention is to provide a carriage for a linear guide system which enables the carriage to be accommodated on a rail element with a further reduced clearance. In addition, the object of the present invention is to provide a linear guide system comprising a carriage and a rail element, in which the carriage comprises a further reduced clearance relative to the rail element.

To solve this object, a carriage for a linear guide system according to independent claim 1 of the present application is proposed. For this purpose, in a carriage of the type mentioned at the beginning, the second slider is fixed to the base body in the upward direction. The second slider is not movably mounted relative to the base body in the upward direction, but is immovable relative to the base body at least in the upward direction.

The present invention relates firstly to such a carriage for a linear guide system, irrespective of the configuration of the rail element required for the linear guide system.

The pull-out direction designates the direction in and against which the carriage is linearly displaceable relative to the rail element in a state mounted on the rail element. If a coordinate system is placed in the linear guide system, the extension direction is defined as the X-axis of this coordinate system.

The upward direction is a direction perpendicular to the pull-out direction, which extends essentially parallel to a rail back of the rail element. In other words, the upward direction is parallel to the spring force exerted by the spring element on the first slider. The upward direction connects the first and second sliders of the first pair of sliders. The term upward direction is used regardless of the instal-lation position of the linear guide system, i.e. the orientation of the back of the rail. In the above coordinate system, the upward direction defines the Y-axis.

A third axis, located perpendicular to the upward direction and perpendicular to the pull-out direction, defines the Z-axis of the above coordinate system. It is understood that the Z-axis is orientated essentially perpendicular to the back of the rail.

It has been shown that known carriages for a linear guide system tend to allow a tilting or swivelling movement of the base body relative to the first and second sliders in contact with the running surfaces of the rail element when rotational moments are introduced into the base body. Such clearance, which allows a rotational movement of the carriage around the Y-axis or around the Z-axis, can have acoustic and haptic disadvantages for the user of a linear guide system.

The measures known from the prior art attempt to prevent possible rotational movement between the base body and the sliders, i.e. in the installed state also between the base body and the rail element, by reducing clearance of the base body relative to the first slider and the second slider, wherein both the first slider and the second slider are each mounted on the base body so that they can move in the upward direction.

In contrast, the idea underlying the present invention is to completely eliminate the clearance of the second slider relative to the base body by fixing it to the base body in the upward direction. In an embodiment of the invention, the second slider is fixed to the base body in all three defined direc-tions, i.e. the X-direction, the Y-direction and the Z-direction, of the coordinate system defined above.

The fixing of the second slider in the upward direction on the base body results in a displacement of a possible axis of rotation, about which the base body could perform a swivelling movement under load relative to the rail element, to a line of contact between the sliding surface of the fixed second slider and a running surface of the rail element. This displacement of the possible axis of rotation reduces the overall play that the carriage has in relation to the rail element.

Despite the restriction of the carriage's degrees of freedom associated by fixing the second slider to the base body, at least in the upward direction, it has surprisingly been shown that it is still possible to realise an easily displaceable linear guide system. The carriage does not tend to jam in relation to the rail element.

The first and second sliders are components which, due to their geometric design and/or their mounting or fixing to the base body, can only slide with their sliding surfaces on the running surfaces of the rail element, but cannot roll. An example of such a slider is a component comprising a cylindrical or partially cylindrical surface that forms the sliding surface. In this case, the cylinder axis is essentially parallel to the pull-out direction of the carriage. It is understood that such a (partially) cylindrical sliding surface can slide on the respective running surface in the specified orientation, but cannot roll on it. Another example of a slider is a component comprising a polygonal cross-sectional plane viewed in a cross-sectional plane perpendicular to the pull-out direction. For example, the slider may comprise sliding surfaces located in a V-shape which, when mounted, are in contact with the running surface of the rail element.

In an embodiment of the present invention, the sliding surfaces of the first and second sliders comprise a projection relative to the base body, so that when the carriage is guided in the rail element, only the sliding surfaces of the first and second sliders are in frictional engagement with the running surfaces of the rail element. In an embodiment of the invention, this condition applies in all load situations, i.e. also in overload situations. In such an overload situation, for example when forces are introduced that lead to a torque for which the linear guide system is not designed in normal operation, only the sliding surfaces of the first and second sliders are in frictional engagement with the running surfaces of the rail element and no surfaces of the base body. Unaffected by this, other sections of the rail element outside the sliding surfaces facing each other, for example the back of the rail, can be in contact with the base body of the carriage. In one embodiment of the invention, the sliding surfaces of the sliders are the only portions of the carriage in contact with the rail element.

In an embodiment, at least the base body or the first slider is arranged in such a way that the first slider undergoes a travel limitation in the event of deflection against a spring force exerted on the first slider in the upward direction, so that the sliding surface of the first slider comprises a projection relative to the base body even in the event of complete deflection, so that only the sliding surfaces of the first and the second sliders are in frictional engagement with the running surfaces of the rail element.

It is understood that, in an embodiment of the invention, at least the base body or the second slider are additionally arranged such that the second slider comprises a projection relative to the base body after it has been mounted on the base body, so that only the sliding surfaces of the first and the second slider are in frictional engagement with the running surfaces of the rail element.

According to an embodiment of the present invention, at least the sliding surface of the first slider or at least the sliding surface of the second slider comprises a slider material, wherein the slider material is different from a base body material of the base body. In an embodiment of the invention, both the sliding surface of the first slider and the sliding surface of the second slider comprise a slider material which is different from the base body material of the base body. In an embodiment of the invention, at least the first slider or the second slider is made of a slider material that is different from the base body material of the base body. Such embodiments have the advantage that at least the sliding surfaces of the first or the second slider, but preferably the sliding surfaces of both sliders or both sliders as a whole, can be produced from a material which comprises better sliding properties, i.e. reduced sliding friction during engagement with the running surfaces of the rail element, than the base body material. However, such materials are generally more expensive and also more complex to process than materials that can be used for the base body, which is irrelevant in terms of its tribological properties.

In an embodiment of the invention, the first and/or the second slider are produced from plastic, preferably by injection moulding. In an embodiment of the invention, the material of the sliding surfaces of at least the first slider or the second slider, but preferably the material of the first slider and the second slider, is a tribopolymer, i.e. a plastic material with reduced sliding friction. Conven-tional plastics containing an additive to reduce the sliding friction can be considered for such a plastic material. An example of such a tribopolymer is POM-AW (polyoxymethylene), for example C 9021-POM, which is commercially available from Celanese under the Hostaform brand.

In an embodiment of the invention, the base body is produced from metal or plastic. In an embodiment of the invention, the base body is produced by plastic injection moulding. In an embodiment, the base body is produced from POM (polyoxymethylene) or PA (polyamide). In particular, the POM or PA comprises no additive for reducing the sliding friction.

In an embodiment of the invention, at least the first slider comprises an elongated friction jaw extending in the pull-out direction and at least one guiding pin extending from the friction jaw in the upward direction. The friction jaw comprises the sliding surface. In such an embodiment, the base body comprises at least one guiding bush extending in the upward direction and complementary to the guiding pin. The at least one guiding pin engages in the at least one guiding bush, so that the first slider is movably mounted in the upward direction relative to the base body.

In an embodiment of the invention, the first slider comprises two guiding pins spaced apart from one another in the pull-out direction, wherein the base body comprises two guiding bushes spaced apart from one another in the pull-out direction and wherein the two guiding pins engage in the two guiding bushes, so that the first slider is movably mounted in the upward direction relative to the base body. Such a pin guide with one or more combinations of guiding pins on the first slider and guiding bushes in the base body enables low-backlash guidance of the movement of the first slider relative to the base body in the upward direction.

In an embodiment of the invention, a first of the two guiding bushes comprises a circular cross-section and a second of the two guiding bushes comprises a cross-section deviating from the circular shape. In an embodiment of the invention, the guiding pin or each of the guiding pins is cylindrical and comprises a circular cross-sectional area.

In an embodiment of the invention, the two guiding pins are located symmetrically on the friction jaw in the pull-out direction.

In an embodiment of the invention, the first slider and the second slider are identical parts. In other words, the first slider and the second slider are arranged identically. Such an embodiment reduces the effort involved in producing the sliders, in particular only a single mould is required for injection moulding the sliders.

Therefore, in an embodiment of the invention, the second slider also comprises an elongated friction jaw extending in the pull-out direction and at least one guiding pin extending from the friction jaw in the upward direction. The friction jaw of the second slider comprises the sliding surface of the second slider. The base body in turn comprises at least one clamping bush extending in the upward direction and complementary to the guiding pin, wherein the at least one guiding pin of the second slider engages in the at least one clamping bush. The at least one guiding pin of the second slider and the respective clamping bush are arranged in such a way that an interference fit results, so that after assembly the second slider is fixed in the upward direction relative to the base body.

It is understood that, in an embodiment of the invention, the second slider also comprises two guiding pins which are spaced apart from one another in the pull-out direction, wherein the base body comprises two clamping bushes which are spaced apart from one another in the pull-out direction and wherein the two guiding pins of the second slider engage in the two clamping bushes.

In one embodiment of the present invention, the interference fit between the at least one guiding pin of the second slider and the associated clamping bush is implemented in that a squeeze bead or a squeeze web, which is elastically deformable, is located on the inner wall surface of the clamping bush. Such a squeeze bead or squeeze web protrudes from the cylindrical surface of the clamping bush and elastically deformably reduces its free cross-section.

In an embodiment of the invention, the spring element is a coil spring.

In an embodiment of the invention, the spring element is supported on the first slider and on the second slider. Such an embodiment makes it possible, in particular if the first slider and the second slider are identical parts, to design the spring element, preferably a coil spring, to be as long as possible. This would not be structurally possible if the spring element were only supported on the first, movably mounted slider and on the base body.

In an embodiment of the invention, the friction jaw comprises a T-shaped design, apart from one or more guiding pins if necessary. In this case, the transverse beam of the T-shape carries the sliding surface. The vertical bar of the T-shape, on the other hand, serves as a support element for holding the spring element. If the spring element is a coil spring, the vertical bar of the T-shape extends into the interior of the coil spring in an embodiment. Therefore, in an embodiment of the invention, the first slider and the second slider each comprise an elongated friction jaw extending in the pull-out direction and a support pin extending in the upward direction from the friction jaw. The support pin of the first slider is referred to as the first support pin, the support pin of the second slider as the second support pin. In such an embodiment, the spring element is a coil spring, wherein the first support pin and the second support pin extend into the coil spring from opposite sides.

Such an embodiment comprises the advantage that the coil spring cannot perform a deflection or buckling movement during compression. This is prevented by the first and second support pins. Although it is possible in principle to mould such a support pin to the base body to support the spring element on the side of the second slider fixed in the upward direction, this is very costly for mould construction. This results in a further advantage if the second slider is provided as a separate component from the base body and is arranged identically to the first slider in this respect.

In an embodiment of the present invention, at least the base body or the first slider comprises a clearance reducing means, wherein the clearance reducing means is arranged such that the first slider is mounted on the base body substantially free of clearance, so that at least a rotational movement of the base body relative to the first slider about an axis of rotation parallel to the upward direction is blocked by the clearance reducing means or a rotational movement of the base body relative to the first slider about an axis of rotation perpendicular to the upward direction and to the pull-out direction is blocked by the clearance reducing means.

Such a clearance reducing means can comprise very different configurations. It is understood that in an embodiment of the invention, a plurality of clearance reducing means may be provided on the base body and/or on the first slider.

In particular, in an embodiment of the invention, a clearance reducing means or a part thereof is also provided on the second slider. In addition to fixing the second slider to the base body in the upward direction, this clearance reducing means then has the effect of fixing it to the base body in order to block a rotational movement of the base body relative to the second slider about an axis of rotation parallel to the upward direction and/or a rotational movement of the base body relative to the second slider about an axis of rotation perpendicular to the upward direction and to the pull-out direction.

In an embodiment, the carriage comprises a second pair of sliders consisting of a third slider and a fourth slider with sliding surfaces facing away from each other. Such a second pair of sliders increases the stability of the guide system and reduces the clearance between the base body and the rail element when the carriage is installed.

It is understood that, in at least one embodiment of the invention, the fourth slider is also fixed to the base body in the upward direction. In an embodiment of the invention, the second and fourth sliders can be brought into contact with the same running surfaces of the rail element or are in contact therewith.

In an embodiment of the invention, the first, the second, the third and the fourth slider are identical parts.

At least one of the aforementioned objects is also solved by a linear guide system comprising a rail element, which rail element comprises two running surfaces facing each other, and a carriage according to an embodiment as described above. The carriage and the rail element are linearly displaceable relative to one another in and against the pull-out direction and the first slider and the second slider are each in frictional engagement with one of the running surfaces of the rail element.

Further advantages, features and possible applications of the present invention become apparent from the following description of an embodiment and the associated figures. In the figures, identical elements are identified by identical reference numbers.

Figure 1:
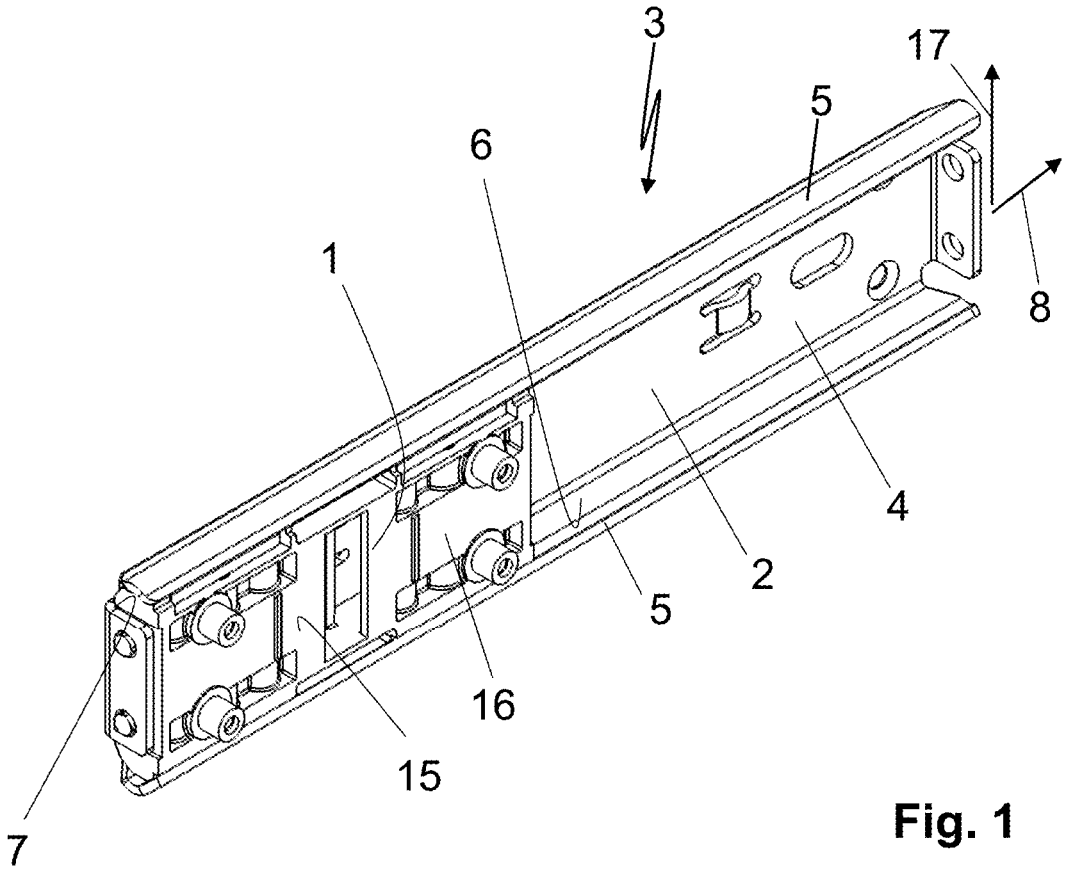
FIG. 1 is an isometric view of a linear guide system according to the invention.
Figure 2:
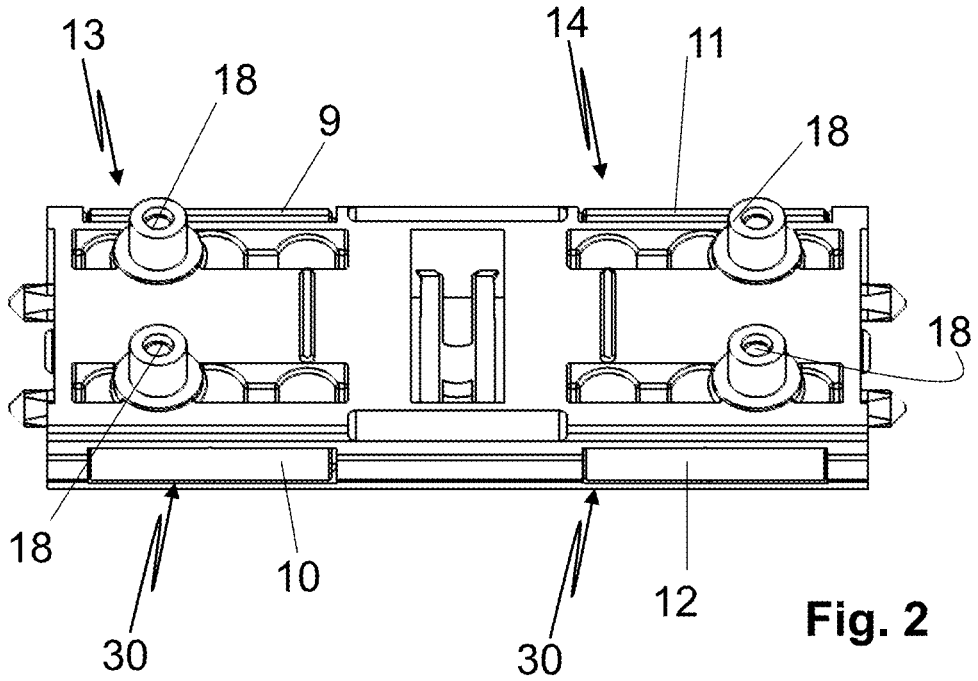
FIG. 2 is an oblique top view of a first longitudinal side of the carriage of the linear guide system of FIG. 1.
Figure 3:
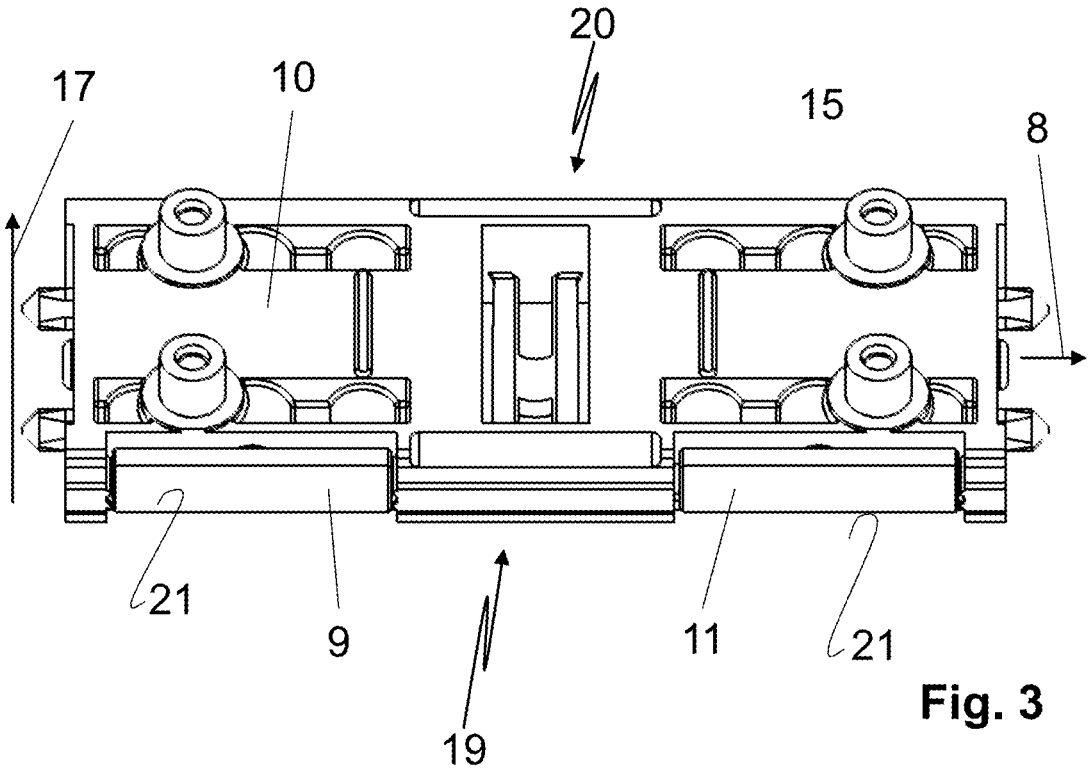
FIG. 3 is an oblique top view of a second longitudinal side of the carriage of FIGS. 1 and 2.
Figure 4:
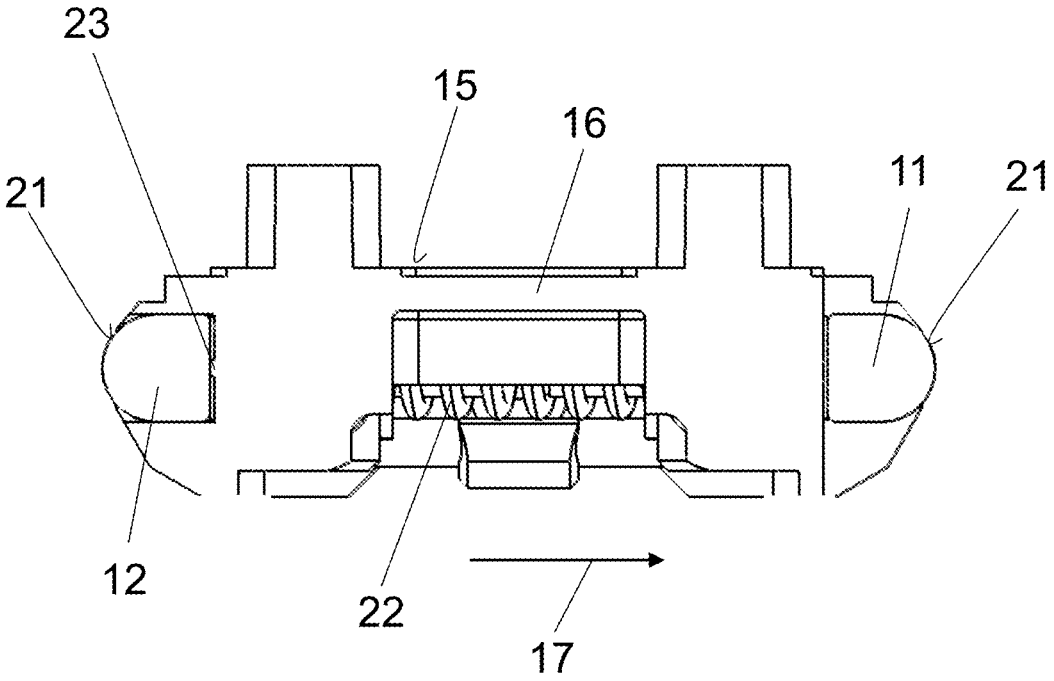
FIG. 4 is a side view of the carriage cut along line A-A of FIG. 3.
Figure 5:
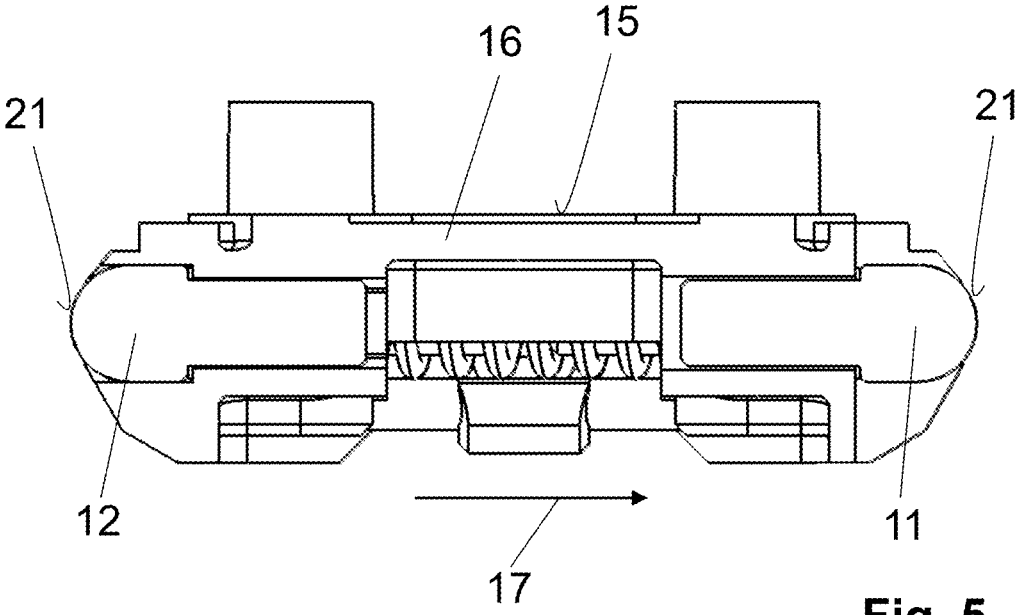
FIG. 5 is a side view of the carriage, cut along line B-B of FIG. 3.

The carriage 1 shown in the figures is used to implement a linear movement along a linear or straight path in a rail element 2. Together with the rail element 2, the carriage 1 forms a linear guide system in the form of a linear guide 3. Such a linear guide 3 is shown in the view from FIG. 1.

The rail element 2 of the linear guide 3 comprises a rail back 4, which connects two legs 5 located opposite each other. The legs 5 carry the running surfaces 6, 7 of the rail element 2. The legs 5 of the rail element 2 are bent in a semi-circular shape, so that an approximately C-shaped profile is formed in cross-section perpendicular to the pull-out direction 8.

The carriage 1 is accommodated within the C-shaped profile of the rail element 2. The carriage 1 is supported on the sliding surfaces 6, 7 exclusively by the sliders 9, 10, 11, 12 described in detail below and is thus guided by the running surfaces 6, 7 of the rail element 2.

The carriage 1 is designed for linear movement in and against a pull-out direction 8 on the rail element 2. The direction perpendicular to the pull-out direction 8 and essentially parallel to the rail back 4 of the rail element 2 or parallel to the surface 15 of the base body 16 shown in the figures is referred to as the upward direction 17 of the carriage 1 or the rail element 2 or the linear guide 3 as a whole.

The carriage 1 has a base body 16, which serves as a carrier for a mobile component that is attached to the base body 16. Such a mobile component is, for example, a drawer that is to undergo a linear extension movement relative to a stationary component to which the rail element 2 is screwed. For this purpose, the base body 16 of the carriage 1 comprises internal threads 18 as fastening means, which can be connected with screws.

The general structure of the carriage 1 can be seen in the various views of the carriage 1 in FIGS. 2 to 6. The base body 16 of the carriage 1 comprises two longitudinal sides 19, 20, which extend in the pull-out direction 8 and opposite the running surfaces 6, 7 of the rail element 2. In the area of these longitudinal sides 19, 20, all surfaces of the base body 16 are arranged in such a way that in no operating situation are they levelled with the sliding surfaces 21 of the sliders 9, 10, 11, 12 or even protrude in relation to them in the direction of the running surfaces 6, 7. This can be clearly seen in the sectional views in FIGS. 4 to 6. In all operating situations, the base body 16 comprises a clearance relative to the running surfaces 6, 7 of the rail element 2. In no operating situation does the base body 16 come into contact with the rail element 2 in the area of its running surfaces 6, 7.

The actual guidance of the carriage 1 on the rail element 2 is provided by the sliders 9, 10, 11, 12 located in pairs on the base body 16. The first pair 13 of sliders is formed by the sliders 9, 10 and the second pair of sliders 14 by the sliders 11, 12. The two sliders of a pair of sliders are each supported on the opposite running surfaces 6, 7 of the rail element 2. The two pairs of sliders 13, 14 are located symmetrically on the base body 16 with respect to the pull-out direction 8.

In the embodiment shown, the second and fourth sliders 10, 12 are fixed to the base body 16 in the upward direction 17, i.e. the second and fourth sliders 10, 12 are not movable relative to the base body 16 in the upward direction 17. A stop 23 recognisable in the sectional view from FIG. 4 ensures that the sliding surface 21 of the respective fixed slider 10, 12 comprises a defined position in relation to the base body 16 and a projection in the area of the running surfaces 6, 7 of the rail element 2 in relation to all surfaces of the base body 16.

In contrast, the first slider 9 and the second slider 11 of the two pairs of sliders 13, 14 are movably mounted on the base body 16 in the upward direction 17. A coil spring 22 biases the respective slider 9, 11 away from the fixed slider 10, 12 of the respective pair 13, 14 and thus towards one of the running surfaces 6, 7 of the rail element 2. It is immediately apparent from the sectional views of FIGS. 4 and 5 that, by fixing the second and fourth sliders 10, 12 in the upward direction, a possible axis of rotation of the base body is shifted into the area of the sliding surfaces of the second and fourth sliders 10, 12 fixed relative to the base body 16 when a corresponding force is applied. This reduces the overall play that the base body 16 has in relation to the rail element 2.

In the embodiment shown, all four sliders 9, 10, 11, 12 are identical parts. They are produced by injection moulding in the identical shape. Each of the sliders 9, 10, 11, 12 comprises two guiding pins 24, 25 spaced apart from each other in the pull-out direction 8. The guiding pins 24, 25 are each received in complementary bushes in the base body 16.

The sliders 10, 12, which are fixed in the upward direction 17, are received in clamping bushes 26. The guiding pins 24, 25 and the clamping bushes 26 are arranged in such a way that the guiding pins 24, 25 comprise an oversize relative to the clamping bushes 26, so that an interference fit is provided when the sliders 10, 12 are inserted. This interference fit clamps the fixed sliders 10, 12 to the base body 16 without play.

In contrast, the guiding pins 24, 25 of the first and third sliders 9, 11, which are movable in the upward direction 15, are accommodated in guiding bushes 27 in the base body 16. The guiding pins 24, 25 and the guiding bushes 27 form a clearance fit so that the sliders 9, 11 are movable relative to the base body 16 in the upward direction 17.

Figure 6:
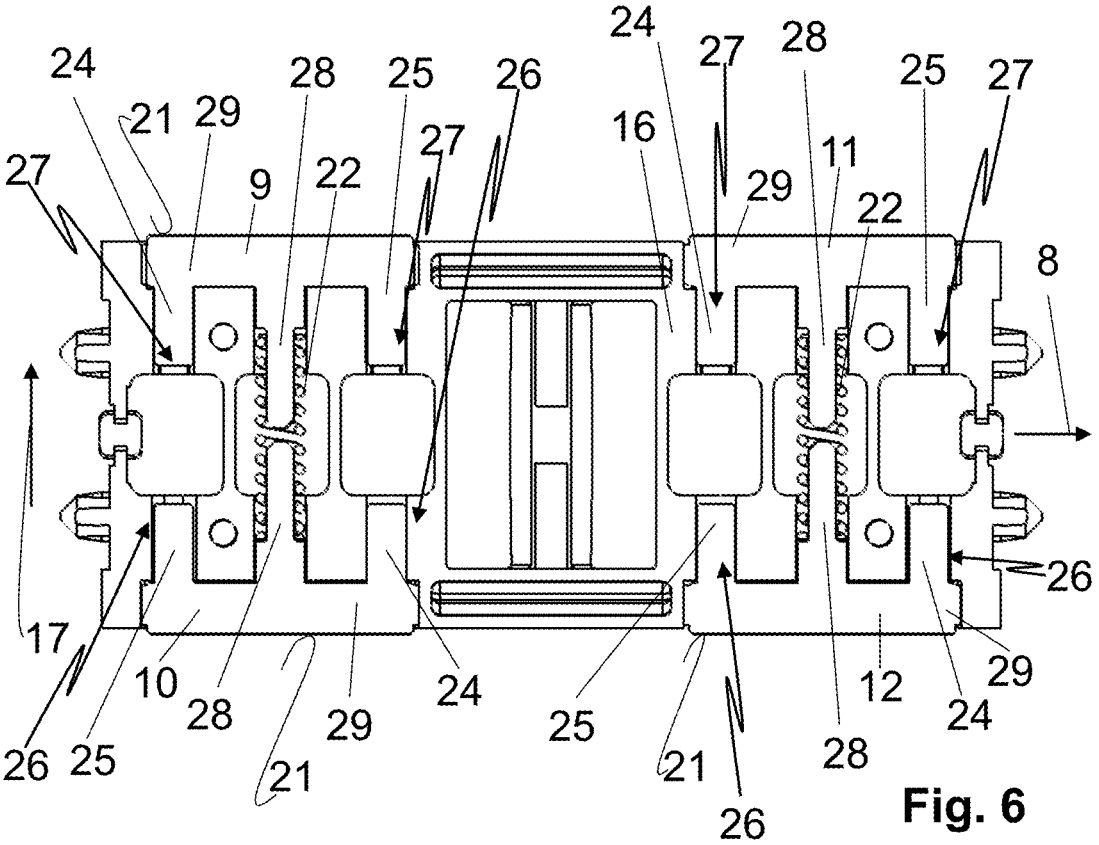
FIG. 6 is a top view of the carriage of FIGS. 1 to 5, cut in a cross-sectional plane spanned by the pull-out direction and the upward direction.

In the sectional view from FIG. 6, it can be seen that each of the sliders 9, 10, 11, 12—apart from the guiding pins 24, 25—comprises a T-shaped basic shape. This is composed of a friction jaw 29 supporting the respective sliding surface 21 and a support pin 28 extending from the friction jaw 29 in the upward direction 17. The two coil springs 22 are supported on the one hand on the fixed sliders 10, 12 and on the other hand on the sliders 9, 11, which are movably mounted in the upward direction 17. For this purpose, the first support pin 28 of the first and third sliders 9, 11 and the second support pin 28 of the second and fourth sliders 10, 12 extend into the coil springs 22 from opposite sides.

In order to provide, in addition to the combination of guiding pin 24, 25 and clamping bush 26, a clamping of the respective slider 10, 12 fixed in the upward direction 17 to a base body 16, the fixed sliders 10, 12 are accommodated in pockets 30 in the base body 16. These pockets 30 are arranged in such a way that they receive the friction jaws of the two sliders 10, 12 in an interference fit.

In the embodiment shown, the base body 16 is produced by injection moulding from POM (polyoxymethylene). The material of the base body does not comprise any additive that reduces sliding friction. Although all four sliders 9, 10, 11, 12 are also produced by injection moulding, they are made of a different material, namely POM-AW, i.e. POM with an additive that reduces sliding friction. This material is more expensive and more complex to process, but comprises a reduced sliding friction compared to the rail element 2.

For the purposes of the original disclosure, it is pointed out that all features as they are apparent to a person skilled in the art from the present description, the drawings and the claims, even if they have been described specifically only in connection with certain further features, can be combined both individually and in any combination with other features or groups of features disclosed here, unless this has been expressly excluded or technical circumstances make such combinations impossible or meaningless. A comprehensive, explicit description of all conceivable combinations of features is omitted here only for the sake of brevity and readability of the description.

Whilst the invention has been illustrated and described in detail in the drawings and the preceding description, this illustration and description is given by way of example only and is not intended to limit the scope of protection as defined by the claims. The invention is not limited to the disclosed embodiments.

Variations of the disclosed embodiments will be apparent to those skilled in the art from the drawings, the description and the appended claims. In the claims, the word "comprising" does not exclude other elements or steps, and the indefinite article "a" does not exclude a plurality. The mere fact that certain features are claimed in different claims does not exclude their combination. Reference numbers in the claims are not intended to limit the scope of protection.

LIST OF REFERENCE SIGNS

1 carriage
2 rail element
3 linear guide
4 rail back
5 leg of rail element 2
6,7 running surface
8 pull-out direction
9, 10, 11, 12 slider
13 first pair of sliders
14 second pair of sliders
15 surface
16 base body
17 upward direction
18 internal thread
19, 20 longitudinal side
21 sliding surface
22 coil spring
23 stop
24, 25 guiding pin
26 clamping bush
27 guiding bush
28 support pin
29 friction jaw
30 pocket

The invention claimed is:

1. A carriage for a linear guide system, wherein the linear guide system comprises a rail element having two running surfaces facing towards each other and the carriage movable relative to the rail element in and against a pull-out direction, wherein the carriage comprises:

a base body, a first pair of a first slider and a second slider comprising sliding surfaces facing away from each other, wherein the sliding surfaces of the first slider and the second slider can each be brought into frictional engagement with one of the running surfaces, and wherein the first slider is mounted to the base body so as to be movable relative to the base body in an upward direction perpendicular to the pull-out direction, and a spring element, wherein the spring element is mounted on the base body in such a way that the spring element biases the first slider in the upward direction away from the second slider, wherein the second slider is fixed to the base body so as to prevent movement relative to the base body in the upward direction.

2. The carriage according to claim 1, wherein the sliding surfaces of the first and the second sliders comprise a projection relative to the base body, so that when the carriage is guided in the rail element, only the sliding surfaces of the first and the second sliders are in frictional engagement with the running surfaces of the rail element.

3. The carriage according to claim 2, wherein at least the base body or the first slider are arranged in such a way that the first slider undergoes a travel limitation in the event of spring deflection against a spring force exerted on the first slider in the upward direction, so that the sliding surface of the first slider comprises a projection relative to the base body even in the event of complete compression, so that only the sliding surfaces of the first and second sliders are in frictional engagement with the running surfaces.

4. The carriage according to claim 1, wherein at least the sliding surface of the first slider or at least the sliding surface of the second slider consists of a slider material, wherein the slider material is different from a base body material of the base body.

5. The carriage according to claim 1, wherein the first slider comprises an elongate extended friction jaw extending in the pull-out direction and at least one guiding pin extending from the friction jaw in the upward direction, wherein the friction jaw comprises the sliding surface, wherein the base body comprises at least one guiding bush extending in the upward direction and being complementary to the guiding pin, wherein the at least one guiding pin engages in the at least one guiding bush, so that the first slider is movably mounted in the upward direction relative to the base body.

6. The carriage according to claim 5, wherein the first slider comprises two guiding pins spaced apart in the pull-out direction, wherein the base body comprises two guiding bushes spaced apart in the pull-out direction and wherein the two guiding pins engage in the two guiding bushes, so that the first slider is movably mounted in the upward direction relative to the base body.

7. The carriage according to claim 6, wherein a first of the two guiding bushes comprises a circular cross-section and wherein a second of the two guiding bushes comprises a cross-section deviating from a circular shape.

8. The carriage according to claim 1, wherein the first slider and the second slider are identical parts.

9. The carriage according to claim 1, wherein the second slider comprises an elongate extended friction jaw extending in the pull-out direction and at least one guiding pin extending from the friction jaw in the upward direction, wherein the friction jaw comprises the sliding surface, wherein the base body comprises at least one clamping bush extending in the upward direction, wherein the guiding pin and the clamping bush form an interference fit and wherein the at least one guiding pin engages in the at least one clamping bush, so that the second slider is fixed to the base body in the upward direction.

10. The carriage according to claim 1, wherein the spring element is supported on the first slider and on the second slider.

11. The carriage according to claim 10, wherein the first slider comprises an elongated friction jaw extending in the pull-out direction and a first support pin extending in the upward direction from the friction jaw, wherein the second slider comprises an elongated friction jaw extending in the pull-out direction and a first support pin extending in the upward direction from the friction jaw, wherein the spring element is a coil spring and wherein the first support pin and the second support pin extend from opposite sides into the coil spring.

12. The carriage according to claim 1, wherein at least the base body or the first slider comprises a clearance reducing means, wherein the clearance reducing means is arranged in such a way that the first slider is mounted on the base body substantially free of play, so that at least a rotational movement of the base body relative to the first slider about an axis of rotation parallel to the upward direction is blocked by the clearance reducing means or a rotational movement of the base body relative to the first slider about an axis of rotation perpendicular to the upward direction and the pull-out direction is blocked by the clearance reducing means.

13. The carriage according to claim 1, wherein the carriage comprises a second pair of a third slider and a fourth slider with sliding surfaces facing away from each other.

14. The carriage according to claim 13, wherein the first, second, third and fourth sliders are identical parts.

15. A linear guide system comprising a rail element comprising two mutually facing running surface, and the carriage according to claim 1, wherein the carriage and the rail element are linearly displaceable relative to each other in and against the pull-out direction, and wherein the first slider and the second slider are each in frictional engagement with one of the running surfaces.

* * * * *